United States Patent [19]

Scott

[11] 4,068,435

[45] Jan. 17, 1978

[54] PRE-STRESSED TENSION RING STRUCTURES

[75] Inventor: Hollis C. Scott, Portland, Oreg.

[73] Assignee: Unadilla Silo Company, Inc., Unadilla, N.Y.

[21] Appl. No.: 756,015

[22] Filed: Jan. 3, 1977

[51] Int. Cl.[2] ..... E04B 1/32

[52] U.S. Cl. ..... 52/223 R; 52/80; 52/81; 52/295; 403/172; 403/217

[58] Field of Search ..... 52/80, 81, 223 R, 573, 52/295; 403/172, 217

[56] References Cited

U.S. PATENT DOCUMENTS

| | | | |
|---|---|---|---|
| 3,041,603 | 6/1962 | Davis | 52/222 |
| 3,270,470 | 9/1966 | Wilkie et al. | 52/82 |
| 3,635,509 | 1/1972 | Birkemeier et al. | 52/81 |
| 3,772,836 | 11/1973 | Gerger | 52/80 |
| 3,894,367 | 7/1975 | Yacoboni | 52/80 |

*Primary Examiner*—Alfred C. Perham
*Attorney, Agent, or Firm*—Klarquist, Sparkman, Campbell, Leigh, Hall & Whinston

[57] ABSTRACT

Plates of a tension ring and launch connectors are pressed radially outwardly relative to a circular dome supporting structure by thrust bolts mounted by bearing plates secured to anchor bolts embedded in a bond beam supported by columns to pre-tension the tension ring and load the bond beam in compression. The tension ring plates bear against bolts trapped in connector plates clamped to the bearing plates.

11 Claims, 7 Drawing Figures

FIG. 1
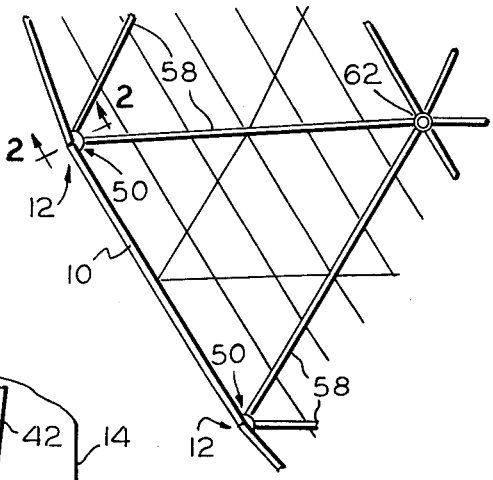
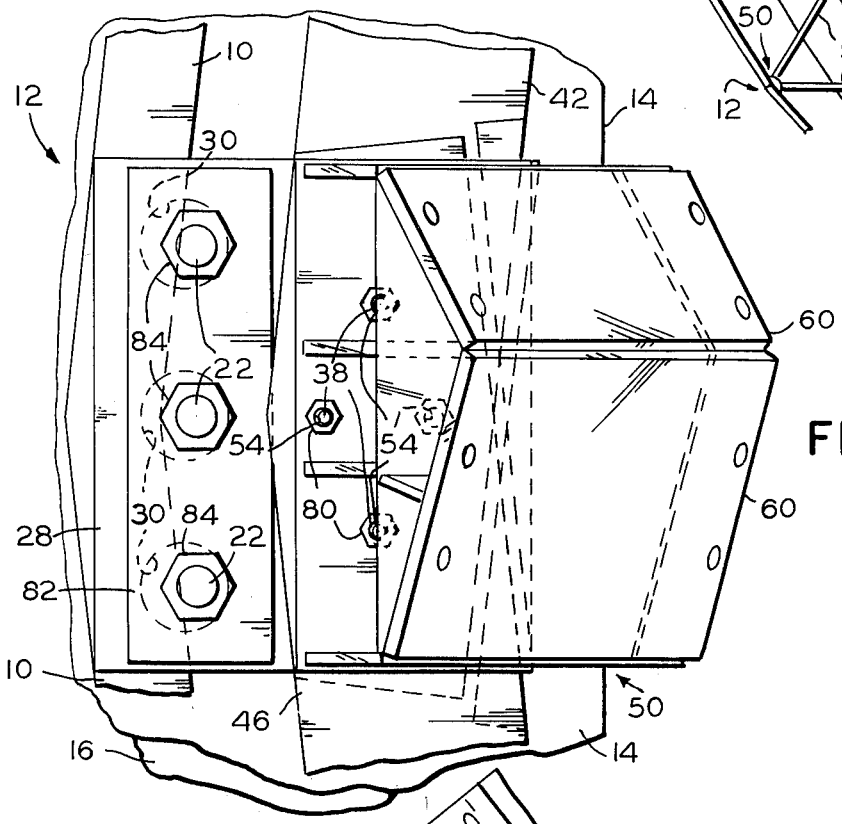
FIG. 3
FIG. 2
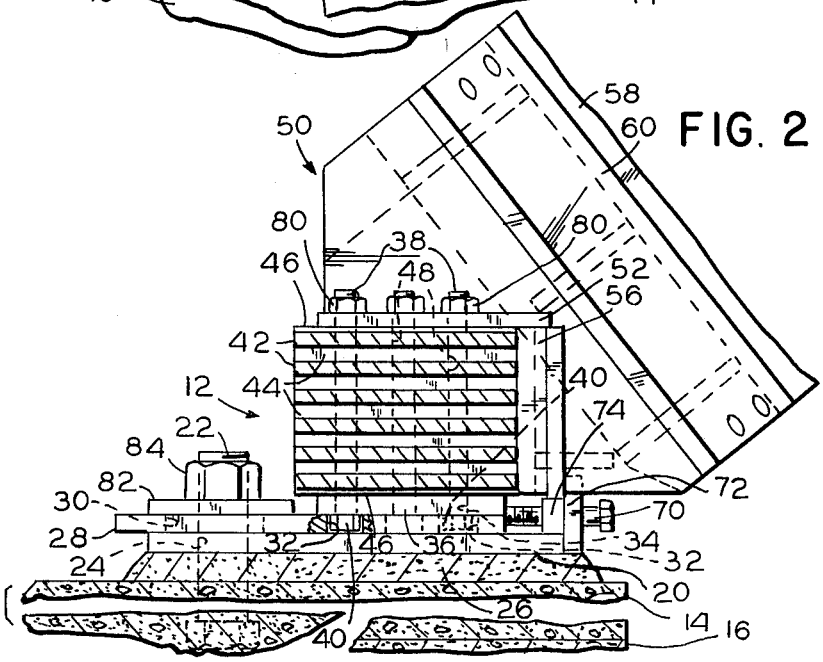

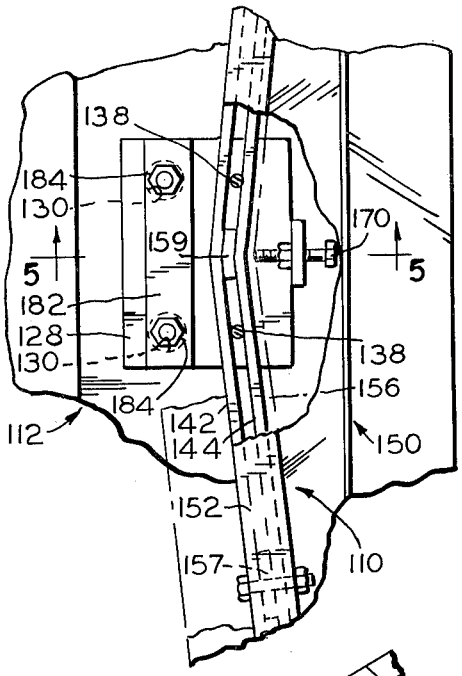
FIG. 4
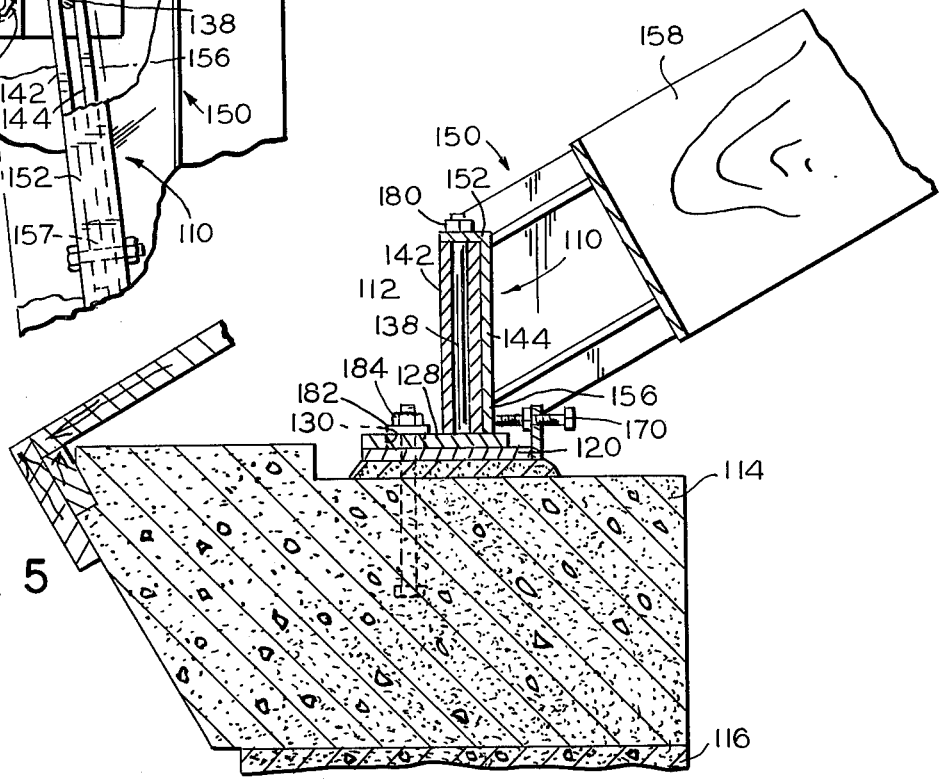
FIG. 5
FIG. 6
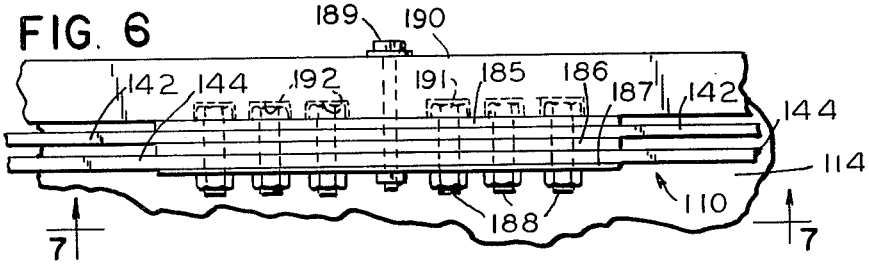
FIG. 7
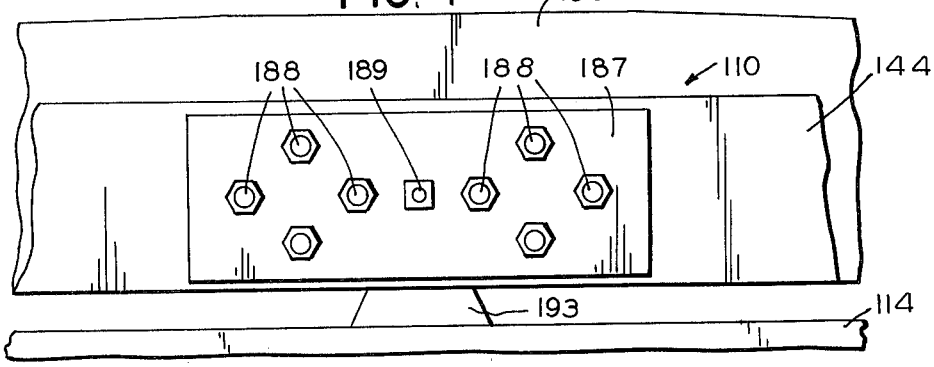

PRE-STRESSED TENSION RING STRUCTURES

DESCRIPTION

This is a substitute for application Ser. No. 593,708, filed July 7, 1975.

This invention relates to pre-stressed tension ring structures, and has for an object thereof the provision of pre-stressed tension ring structures.

Another object of the invention is to provide dome structures wherein roof domes are integrated with supporting wall structures.

Another object of the invention is to provide a tension ring structure in which a tension ring is pre-tensioned by wall means supporting the ring.

A further object of the invention is to provide a tension ring structure wherein tension ring joints tension a tension ring and pre-stress in compression a bond beam forming a part of a wall.

Another object of the invention is to provide improved tension ring joints.

Another object of the invention is to provide a tension ring structure in which a connector plate adjustable on a bearing plate is rigidly connected to a tension ring and is pressed by a thrust bolt to pre-tension the tension ring.

Another object of the invention is to provide improved anchorage of the tension ring joints to a supporting structure.

In the drawings:

FIG. 1 is a fragmentary, top plan view of a dome structure including a pre-stressed tension ring structure forming one embodiment of the invention;

FIG. 2 is an enlarged, vertical sectional view taken along line 2—2 of FIG. 1;

FIG. 3 is an enlarged, top plan view of the structure of FIG. 1;

FIG. 4 is a fragmentary, top plan view of a pre-stressed tension ring structure forming one embodiment of the invention;

FIG. 5 is a vertical sectional view taken along line 5—5 of FIG. 4;

FIG. 6 is a fragmentary, top plan view of a portion of the tension ring structure of FIG. 4; and, FIG. 7 is a front elevation view taken along line 7—7 of FIG. 6.

Referring now in detail to the drawings, there is shown therein a pre-stressed tension ring structure forming one embodiment of the invention and also forming a part of a domed building including a tension ring 10, which is pre-tensioned, and tension ring joints 12, connecting the tension ring to a bond beam 14 to pre-stress the bond beam in compression. The bond beam 14 is a full circle ring of steel reinforced concrete and is integral with and supported by columns 16 of the dome structure.

Each tension ring joint 12 includes a bearing plate 20 placed over anchor bolts 22 embedded in the bond beam 14, holes 24 fitting closely over the bolts. The bearing plate is supported on grout 26. A connector plate 28 has enlarged holes 30 very loosely receiving the anchor bolts 22, and also has hexagonal sockets 32 below bolt holes 34 in a plate 36 welded to the connector plate. Bolts 38 have heads 40 fitting in the hexagonal sockets 32, and extend through the holes 34. Chordal tension ring plates or bars 42, 44 and 46 have stacked or overlapping end portions with holes 48 fitting closely over the bolts 38.

Haunch connectors 50 have base plates 52 resting on the top plate 46 with the bolts 38 extending through holes 54 in the haunch base plate. Vertical plates 56 of the haunch connectors bear against the overlapping chordal plates 42, 44 and 46 of the tension ring. Wood beams 58 are connected to abutments 60 of the haunch connectors, and are connected at their other ends by hub connectors 62 of the dome per se.

Thrust bolts or adjustment screws 70 for pre-stressing the tension ring 10 and bond beam 14 are threaded through lugs 72 of the bearing plates 20 and nuts 74 welded to the bearing plates and lugs. The bolts 70 are radial of the dome and bear against the connector plates 28 and 36.

To assemble the dome, with the bearing plates 20 positioned on the grout 26 and the anchor bolts 22, the bottoms of the connector plates 28 are greased, the connector plates with the heads 40 of the bolts 38 in the sockets 32 are placed on the bearing plates and over the anchor bolts 22. Washer plates 82 are placed over the bolts 22 and under nuts 84, then are hand tightened. The tension ring 10 then is assembled by placing the chordal plates 42, 44 and 46 on the bolts 38, and the connectors 50 are placed on the bolts 38 and tension ring. Erection of the dome skeleton against connectors 50 pushes the tension ring radially outwardly removing slack and engaging the bolts 38 to the sides of the holes 48 after which nuts 80 are wrench tightened on the bolts 38. The thrust bolts 70 then are hand tightened and then given one turn with a wrench. Then the sheathing or decking is placed on the dome to complete the loading of the tension ring. Then the thrust bolts 70 are wrench turned, usually not over two turns, to press the connector plates 28 and bolts 38 radially outwardly to further tension the tension ring to an intended extent and to place the bond beam 14 under compression to the same intended extent. That is, the bond beam is pre-stressed in compression and the tension ring is pre-stressed in tension. The nuts 84 then are wrench tightened. The nuts 84 clamp the plate 28 tightly against the bearing plates. Then, when further loading occurs on the dome, the tension ring is further tensioned and the bond beam after first losing its compression pre-stress also is tensioned but to a lesser amount and takes that lesser part of the load from the tension ring. To support the portions of the chordal plates 42, 44 and 46 between the joints 12, suitable grouting pads on the bond beam are provided along with wood spacers between the portions of the chordal plates above the grouting pads.

Embodiment of FIGS. 4–7

A tension ring structure forming an alternate embodiment of the invention includes a pre-tensioned tension ring 110, tension ring joints 112, a bond beam 114 integral with columns 116 and haunch connectors 150 connected to beams 158 and forming part of the dome per se. The tension ring comprises pairs of angled plates 142 and 144 spliced to other pairs between the tension ring joints 112. Connector plates 128 are clamped tightly to bearing plates 120 after thrust bolts 170 have pre-stressed the tension ring 110 in tension and the bond beam 114 in compression, large holes 130 in the connector plates 128 fitting overly loosely over the anchor bolts, washer plates 182 and nuts 184 being provided. The plates 144 bear against bolts having hexagonal heads trapped in hexagonal sockets in the connector plates 128. Nuts 180 on the bolts 138 press base plates 152 of the connectors 150 against the tension ring plates 142 and 144, and the thrust bolts 170 bear against apices of angular vertical plates 156. Spacers 157 and 159 separate the plates 142 and 144.

In FIGS. 6 and 7, spliced portions of and intermediate supports for the chordal tension ring plates 142 and 144 are shown. The end portions of the plates 142 and 144 are clamped between splicing plates 185, 186 and 187 by bolts 188, tie bolts 189 securing the assemblage against purlins 190 and heads 191 of the bolts being positioned loosely in clearance sockets 192 in the purlins. Grouting pads 193 on the bond beam 114 support the portions of the purlins secured to the splices of the tension ring to prevent sag of the intermediate portions of the tension ring.

What is claimed is:

1. In a tension ring joint,
a bearing plate,
a connector plate slidable on the bearing plate,
connector bolts rigidly secured to the connector plate and adapted to connect the tension ring to the connector plate, and adjustable thrust bolt means including a lug on the bearing plate, and a thrust bolt threadedly engaging the lug and engaging the connector plate for moving the connector plate relative to the bearing plate.

2. The tension ring joint of claim 1 wherein the connector plate has keying and trapping sockets therein and the connector bolts have keying and trapping heads fitting in the sockets.

3. The tension ring joint of claim 1 including anchor bolts holding the bearing plate in a fixed position, the connector plate having large clearance holes receiving the anchor bolts and permitting extensive movement of the connector plate relative to the anchor bolts, and nut means on the anchor bolts clamping the connector plate to the bearing plate.

4. In a pre-stressed tension ring structure,
wall means including a bond beam,
a bearing plate fixed to the bond beam,
connector plate means slidable on the bearing plate,
a tension ring,
connector means rigidly connecting the tension ring to the connector plate,
adjustable thrust means for pressing the tension ring radially outwardly relative to the bond beam to pre-tension the tension ring and press the bond beam radially inwardly to pre-compress the bond beam,
the adjustable thrust means comprising adjustment screw means mounted on the bearing plate and engaging the connector plate means,
and holding means for holding the connector plate means against upward movement relative to the bearing plate.

5. The pre-stressed tension ring structure of claim 4 wherein the adjustment screw means includes a lug on the bearing plate and the adjustment screw being threadedly carried by the lug and engaging the connector plate means.

6. The pre-stressed tension ring structure of claim 5 wherein the connector means comprises bolts carried by the connector plate means.

7. The pre-stressed tension ring structure of claim 6 wherein the holding means comprises anchor bolt means embedded in the bond beam and extending closely through holes in the bearing plate and loosely through holes in the connector plate means and clamping the connector plate means into frictional engagement with the bearing plate.

8. The pre-stressed tension ring structure of claim 4 wherein the connector means comprises upstanding bolts fixed to the connector plate means.

9. The pre-stressed tension ring structure of claim 8 wherein the tension ring comprises a plurality of chordal plates stacked in horizontal planes with end portions overlapping and having holes through which the upstanding bolts extend to splice the chordal plates together.

10. The pre-stressed tension ring structure of claim 8 wherein the tension ring comprises a plurality of concentric chordal plates having angular central portions on the connector plate means and between which the upstanding bolts extend.

11. In a tension ring structure,
a plurality of pairs of angular concentric tension ring plates having apices at the central portions thereof,
a plurality of tension ring joints connected to the central portions of the tension ring plates,
a plurality of splices between the tension ring joints connecting the end portions of the tension ring plates together,
and a bond beam,
each tension ring joint including a bearing plate anchored to the bond beam, a connector plate connected to the central portions of the tension ring plates and pre-stressing means pressing the connector plate outwardly to tension the tension ring and compress the bond beam.

* * * * *